US010819077B2

(12) United States Patent
Chawgo

(10) Patent No.: US 10,819,077 B2
(45) Date of Patent: Oct. 27, 2020

(54) COMPRESSION TOOL WITH BIASING MEMBER

(71) Applicant: John Mezzalingua Associates, LLC, Liverpool, NY (US)

(72) Inventor: Shawn M. Chawgo, Cicero, NY (US)

(73) Assignee: JOHN MEZZALINGUA ASSOCIATES, LLC, Liverpool, NY (US)

( * ) Notice: Subject to any disclaimer, the term of this patent is extended or adjusted under 35 U.S.C. 154(b) by 376 days.

(21) Appl. No.: 15/188,494

(22) Filed: Jun. 21, 2016

(65) Prior Publication Data

US 2016/0301173 A1 Oct. 13, 2016

Related U.S. Application Data

(60) Continuation-in-part of application No. 13/868,636, filed on Apr. 23, 2013, now abandoned, which is a (Continued)

(51) Int. Cl.
*H01R 43/048* (2006.01)
*H01R 43/042* (2006.01)
*B25B 27/10* (2006.01)

(52) U.S. Cl.
CPC ..... *H01R 43/0486* (2013.01); *B25B 27/10* (2013.01); *H01R 43/0427* (2013.01); (Continued)

(58) Field of Classification Search
CPC ..... H01R 43/048; H01R 43/058; H01R 43/0427; H01R 9/0518; H01R 9/0524; (Continued)

(56) References Cited

U.S. PATENT DOCUMENTS 2,102,645 A 12/1937 Replogle
2,182,663 A 12/1939 Eby et al.
(Continued)

FOREIGN PATENT DOCUMENTS

CN 2347538 11/1999
CN 1706332 12/2005
(Continued)

OTHER PUBLICATIONS

Office Action dated Jan. 29, 2010 for Chinese Patent App No. 200710180741.2.
(Continued)

*Primary Examiner* — Peter Dungba Vo
*Assistant Examiner* — Jeffrey T Carley
(74) *Attorney, Agent, or Firm* — Barclay Damon LLP

(57) ABSTRACT

An assembly comprises a compression member configured to receive a force input from a compression tool and a frame including a cradle at one end, an end fitting at the other, and at least one structural member linking the cradle to the end fitting. The cradle is configured to engage one end of the connector and receives the prepared end of the coaxial cable. The end fitting is configured to detachably connect the frame to the compression tool and includes an aperture for receiving the force input from the compression tool. The structural member defines at least one surface configured to guide the compression member along the axis in response to the force input. The compression member imposes an axial force on the other end of the connector and is guided along the axis by the guide surface of the frame.

6 Claims, 8 Drawing Sheets

Related U.S. Application Data continuation of application No. 13/041,257, filed on Mar. 4, 2011, now Pat. No. 8,661,656, which is a division of application No. 11/900,124, filed on Sep. 10, 2007, now Pat. No. 7,908,741.

(52) U.S. Cl.
CPC .... *Y10T 29/49185* (2015.01); *Y10T 29/53213* (2015.01); *Y10T 29/53222* (2015.01); *Y10T 29/53226* (2015.01); *Y10T 29/53235* (2015.01)

(58) Field of Classification Search
CPC ..... H01R 24/56; Y10T 29/53226; Y10T 29/53222; Y10T 29/53213; Y10T 29/49185; Y10T 29/49123
See application file for complete search history.

(56) References Cited

U.S. PATENT DOCUMENTS 2,371,423 A 3/1945 Buchet
2,554,328 A 5/1951 Grimes
2,805,591 A 9/1957 Widmer
3,263,481 A 8/1966 Boyd et al.
3,299,496 A 1/1967 Christensen
3,315,337 A 4/1967 Stull
3,325,885 A * 6/1967 Ziegler, Jr. ..... H01R 43/00 29/751
3,334,511 A 8/1967 Hawkins
3,365,927 A 1/1968 Lynch
3,374,521 A 3/1968 Clarke
3,423,987 A 1/1969 Kingler
3,477,120 A 11/1969 Werner et al.
3,495,670 A 2/1970 Ditson
3,644,989 A 2/1972 Morby et al.
3,653,115 A 4/1972 Perkins
3,660,883 A 5/1972 Hoeckele
4,005,516 A 2/1977 Bakermans
4,136,549 A 1/1979 Lytle et al.
4,170,125 A 10/1979 Minka
4,174,560 A 11/1979 Senior et al.
4,178,669 A 12/1979 Nara et al.
4,189,817 A 2/1980 Moebius
4,257,135 A 3/1981 Moebius
4,386,461 A 6/1983 Plummer
4,498,563 A 2/1985 Trahan
4,730,385 A * 3/1988 Ryan ..... B25B 13/48 29/750
4,774,762 A 10/1988 Gobeil
4,785,517 A 11/1988 Takano
4,932,091 A * 6/1990 Krzyzanski ..... H01R 43/042 29/758
5,000,155 A 3/1991 Gallagher
5,099,561 A 3/1992 Santiago Lozano
5,105,648 A 4/1992 Steiner et al.
5,138,864 A 8/1992 Tarpill
5,222,292 A 6/1993 Comerci et al.
5,297,312 A 3/1994 Zuiderveen et al.
5,363,834 A 11/1994 Stuchlik
5,367,756 A 11/1994 Huetinck
5,375,309 A 12/1994 Dunn
5,392,508 A 2/1995 Holliday et al.
5,398,394 A 3/1995 Hyatt et al.
5,402,561 A 4/1995 Cerquone et al.
5,483,731 A 1/1996 Prendel et al.
5,537,727 A 7/1996 Mayer
5,550,059 A 8/1996 Boger et al.
5,596,800 A 1/1997 Holliday et al.
5,615,292 A 3/1997 Beckwith
5,647,119 A 7/1997 Bourbeau et al.
5,680,687 A 10/1997 Hyatt et al.
5,722,147 A 3/1998 Brazle
5,743,131 A 4/1998 Holliday et al.
5,749,604 A 5/1998 Williams
5,802,690 A 9/1998 Bullock
5,845,393 A 12/1998 DePalva
5,934,137 A 8/1999 Tarpill
5,941,120 A 8/1999 Jee
6,026,897 A 2/2000 Pringle et al.
6,089,913 A 7/2000 Holliday
6,112,404 A 9/2000 Tarpill
6,116,069 A * 9/2000 Holliday ..... H01R 43/048 29/237
6,131,261 A 10/2000 Michlin
6,146,141 A 11/2000 Schumann
6,205,653 B1 3/2001 Perez et al.
6,220,074 B1 4/2001 Montminy et al.
6,227,030 B1 5/2001 Lefavour et al.
6,230,542 B1 5/2001 Frenken ..... 72/456
6,272,738 B1 8/2001 Holliday et al.
6,276,186 B1 8/2001 Frenken
6,293,004 B1 9/2001 Holliday
6,324,739 B1 12/2001 Fujii et al.
6,347,450 B1 2/2002 Langlois et al.
6,363,560 B1 * 4/2002 Kesinger ..... H01R 43/042 7/107
6,415,499 B1 * 7/2002 Holland ..... B25B 27/10 29/564.4
6,446,482 B1 9/2002 Heskey et al.
6,463,778 B1 10/2002 Johnston
6,532,790 B2 3/2003 Frenken
6,536,103 B1 3/2003 Holland et al.
6,550,119 B2 4/2003 Ishida et al.
6,551,128 B2 4/2003 Asai et al.
6,591,487 B2 7/2003 Chang
6,594,888 B2 * 7/2003 Chang ..... B25B 27/10 29/751
6,658,711 B1 12/2003 Benson
6,671,944 B2 * 1/2004 Holliday ..... H01R 43/042 29/564.4
6,676,446 B2 1/2004 Montena
6,684,679 B2 2/2004 Hsieh
6,691,402 B2 2/2004 Chang
6,708,396 B2 3/2004 Holliday
6,718,870 B1 * 4/2004 Frenken ..... B25B 27/10 100/102
6,732,393 B1 5/2004 Liao
6,733,336 B1 5/2004 Montena et al.
6,769,173 B2 8/2004 Chadbourne
6,780,052 B2 8/2004 Montena et al.
6,792,789 B1 9/2004 Faucher
6,807,728 B2 10/2004 Griffin et al.
6,808,415 B1 10/2004 Montena
6,820,326 B1 11/2004 Tarpill et al.
6,848,940 B2 2/2005 Montena
6,887,103 B2 5/2005 Montena et al.
6,901,647 B2 6/2005 Foster et al.
6,948,234 B1 9/2005 Steiner
7,028,393 B2 4/2006 Wei
7,029,326 B2 4/2006 Montena
D520,828 S 5/2006 Steiner
7,070,447 B1 7/2006 Montena
7,096,573 B2 8/2006 Holliday
7,120,997 B2 10/2006 Islam et al.
7,124,608 B2 10/2006 Goop
7,124,619 B1 10/2006 Lefavour et al.
7,131,868 B2 11/2006 Montena
7,152,309 B2 12/2006 Liao
7,165,439 B2 1/2007 Lefavour et al.
7,188,507 B2 3/2007 Holliday et al.
7,225,532 B2 6/2007 Wei
7,255,598 B2 8/2007 Montena et al.
7,275,293 B2 10/2007 Wathey
7,299,542 B2 11/2007 Montena
7,299,543 B2 11/2007 Montena
7,318,272 B1 1/2008 Steiner
7,322,085 B1 1/2008 Benson
7,346,980 B2 3/2008 Liao
7,363,799 B2 4/2008 Hamm et al.
7,421,768 B2 9/2008 Chiang
7,426,782 B2 9/2008 Johnson et al.
7,444,744 B2 11/2008 Caveney et al.
7,475,475 B2 1/2009 Sullivan
7,506,531 B1 3/2009 Lendway, IV et al.

(56) References Cited

U.S. PATENT DOCUMENTS

| | | | | |
|---|---|---|---|---|
| 7,562,442 | B2 | 7/2009 | Montena | |
| 7,908,741 | B2 | 3/2011 | Chawgo | |
| 7,921,549 | B2 | 4/2011 | Chawgo et al. | |
| 8,272,128 | B2 | 9/2012 | Chawgo et al. | |
| 2003/0150105 | A1 | 8/2003 | Araki | |
| 2003/0204943 | A1 | 11/2003 | Geurts | |
| 2004/0128814 | A1 | 7/2004 | Esson et al. | |
| 2004/0177495 | A1 | 9/2004 | Itrich | 29/754 |
| 2006/0143904 | A1* | 7/2006 | Holliday | B25B 27/10 29/751 |
| 2006/0179646 | A1* | 8/2006 | Xie | H01R 43/048 29/750 |
| 2006/0179647 | A1* | 8/2006 | Montena | H01R 9/0518 29/751 |
| 2006/0191132 | A1 | 8/2006 | Montena | |
| 2006/0236500 | A1 | 10/2006 | Oh et al. | |
| 2006/0288552 | A1 | 12/2006 | Roll et al. | |
| 2006/0292925 | A1 | 12/2006 | Chawgo | |
| 2007/0251085 | A1* | 11/2007 | Holliday | B21D 39/048 29/751 |
| 2008/0010825 | A1* | 1/2008 | Chawgo | H01R 43/0425 29/854 |
| 2008/0201941 | A1 | 8/2008 | Montena | |
| 2008/0263859 | A1 | 10/2008 | Wang et al. | |
| 2009/0013523 | A1 | 1/2009 | Westley et al. | |
| 2009/0014212 | A1 | 1/2009 | Malak | |
| 2009/0064754 | A1 | 3/2009 | Chawgo | |
| 2009/0144974 | A1 | 6/2009 | Sullivan | |
| 2011/0173810 | A1 | 7/2011 | Chawgo et al. | |
| 2011/0179639 | A1 | 7/2011 | Chawgo et al. | |
| 2012/0096712 | A1 | 4/2012 | Chawgo et al. | |
| 2012/0222295 | A1 | 9/2012 | Chawgo | |
| 2012/0222297 | A1 | 9/2012 | Chawgo | |
| 2012/0222300 | A1 | 9/2012 | Chawgo | |
| 2013/0232777 | A1 | 9/2013 | Chawgo | |
| 2013/0232785 | A1 | 9/2013 | Chawgo | |
| 2013/0232786 | A1 | 9/2013 | Chawgo | |

FOREIGN PATENT DOCUMENTS

| | | |
|---|---|---|
| EP | 0786228 | 7/1997 |
| GB | 1072418 | 6/1967 |
| GB | 1416360 | 12/1975 |
| TW | 477738 | 3/2002 |
| TW | M259386 | 3/2005 |

OTHER PUBLICATIONS

Official Action dated Dec. 23, 2008 for Russian Patent App No. 2007137336.12.

PCT/US2008/075073 Korean Intellectual Property Office, The International Search Report and Written Opinion of International Searching Authority, dated Apr. 3, 2009. 11 pages.

Office Action (dated Oct. 17, 2012) for U.S. Appl. No. 13/041,269, filed Mar. 4, 2011.

U.S. Appl. No. 13/869,295, filed Apr. 24, 2013.

U.S. Appl. No. 13/869,372, filed Apr. 24, 2013.

U.S. Appl. No. 12/911,820, filed Oct. 26, 2010.

U.S. Appl. No. 13/041,257, filed Mar. 4, 2011.

U.S. Appl. No. 13/041,264, filed Mar. 4, 2011.

U.S. Appl. No. 13/041,269, filed Mar. 4, 2011.

U.S. Appl. No. 13/077,632, filed Mar. 31, 2011.

U.S. Appl. No. 13/868,514, filed Apr. 23, 2013.

PCT/US2008/075073 International Preliminary Report on Patentability / Written Opinion dated Mar. 25, 2010. 6 pages.

* cited by examiner

COMPRESSION TOOL WITH BIASING MEMBER

RELATED APPLICATIONS

This is a continuation-in-part of, and claims priority to, U.S. patent application Ser. No. 13/868,636 filed Apr. 23, 2013 which is a continuing application of, and claims priority to, U.S. patent application Ser. No. 13/041,257 filed Mar. 4, 2011, now issued as U.S. Pat. No. 8,661,656, which is a divisional application of, and claims priority to, U.S. patent application Ser. No. 11/900,124 filed Sep. 10, 2007, now issued as U.S. Pat. No. 7,908,741 with the United States Patent and Trademark Office.

FIELD OF THE INVENTION

This invention relates generally to installing a connector onto a coaxial cable, and more specifically, to a compression tool for use in combination therewith for securing a prepared end of a coaxial cable with a cable connector.

BACKGROUND OF THE INVENTION

A wide variety of compression type end connectors have recently been developed for use in the cable industry. These devices have found wide acceptance due to ease of manufacture and lack of complexity both in design and in use. For example, compression type connectors for use with braided coaxial cables typically include a hollow body, a hollow post mounted within the body passing through an end of a coaxial cable, and a threaded nut rotatably mounted to an extended end of the post. Generally, the post includes an outwardly projecting, radially extending flange while the nut includes an inwardly projecting lip operative to engage the flange while facilitating rotation of the nut about an elongate axis.

An annular compression ring is mounted to the connector body and arranged to move axially onto and over the back end of the body. More specifically, one end of a coaxial cable is prepared by stripping back the cable to expose the signal-carrying center connector. Additionally, the braided, woven metal outer conductor is exposed by stripping the compliant outer jacket and folding the woven outer conductor over the outer jacket. The coaxial cable is then passed through the annular compression ring and into the back end of the body, while at the same time, allowing the hollow conductive post to pass between the woven metal mesh and an inner dielectric layer of the cable. As a consequence, an electrical path is produced from the conductive wire mesh of the cable to an outer conductive sleeve of an interface port through the conductive post. This path functionally grounds the coaxial cable to protect the signal carrying inner conductor. Alternatively, if a biasing member is positioned between the body and the nut, a secondary grounding path may be established from the wire mesh to the conductive post, to a conductive lip of the nut (from the flange of the post), through the conductive threads of the nut and into the outer conductive threads of the interface port. This connection, while somewhat convoluted, can provide an important secondary grounding path.

Installation of the connector is completed by axial movement of the compression ring over an inclined surface to compress the ring over the outer surface of the coaxial cable. More specifically, this configuration secures the end of the cable to the connector by compressing the outer jacket and wire mesh outer conductor against the conductive post while, at the same time, providing an electrical ground path for the coaxial cable. Connectors for use with other types of cables (e.g., corrugated cables, smooth wall cables) may also include a compression ring to compress/engage the cable with the connector.

Although most of the compression-type end connectors work well for securing the coaxial cable to the connector, an installer oftentimes has difficulty applying a sufficiently high, axially-directed, force to effect a secure connection. Inasmuch as there are no surfaces guiding the annular compression ring over the connector body, it is not uncommon for the compression ring to become misaligned during engagement. That is, a force that is applied "off-axis" will not properly deform the compression ring, thus resulting in a non-optimum connection between the connector and the cable.

Consequently, a need exists for a compression tool for installing a coaxial cable connector onto a coaxial cable which is suitable for use with a variety of different connector types/cable sizes.

SUMMARY OF THE INVENTION

A tool fixture for use in combination with a compression tool comprising a compression member configured to receive a force input from the compression tool and a frame including a cradle at one end, an end fitting at the other, and at least one structural member linking the cradle to the end fitting. The cradle is configured to engage one end of the connector and receives the prepared end of the coaxial cable. The end fitting is configured to detachably connect the frame to the compression tool and includes an aperture for receiving the force input from the compression tool. The structural member defines at least one surface configured to guide the compression member along the axis in response to the force input. The compression member imposes an axial force on the other end of the connector and is guided along the axis by the guide surface of the frame.

A method is also provided for connecting a coaxial cable to a cable connector including the steps of preparing an end of a coaxial cable, sliding a compression ring over the prepared end of the coaxial cable and inserting the prepared end of the coaxial cable into an end of the connector. The method further includes the steps of attaching a frame to a compression tool such that an extensible plunger extends through an aperture of the frame at one end and aligns with a cradle at other end. The connector is then inserted into the cradle such that one the end of the connector is retained by a shoulder of the cradle and is received into a compression sleeve connected to an outboard end of the extensible plunger. The compression tool is then activated to drive the extensible plunger along the elongate axis of the connector such that: (i) the frame guides the extensible plunger along the longitudinal axis of the connector and (ii) the compression ring is compressed over an end of the connector to attach the prepared end of the coaxial cable to the connector.

BRIEF DESCRIPTION OF THE DRAWINGS

The drawings are not necessarily to scale, emphasis instead generally being placed upon illustrating the principles of the invention. In the drawings, like numerals are used to indicate like parts throughout the various views.

DETAILED DESCRIPTION OF THE INVENTION

FIGS. 1*a*-1*d* illustrate cross-sectional views of various cable connectors suitable for connection to a coaxial cable using a hydraulic compression tool in accordance with the present invention. The subsequent embodiments generally include a compression tool comprising a hydraulic, pneumatic or battery-powered assembly/portion and a frame assembly/portion. The hydraulic, pneumatic or battery-powered assembly/portion produces an force input while the frame assembly/portion guides a compression ring onto the end of a connector body.

Figure 1A:
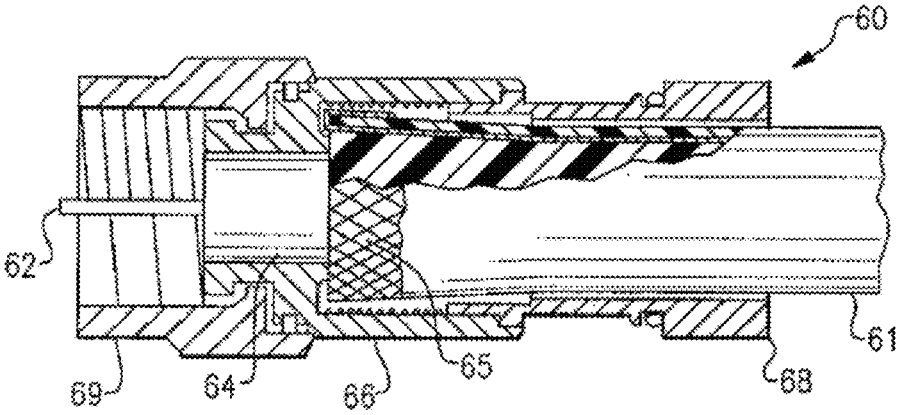
FIGS. 1*a*-1*d* illustrate cable connectors of different types suitable to be installed using a hydraulically/pneumatically/electrically powered compression tool for use in combination with a frame assembly in accordance with the present invention.
Figure 1B:
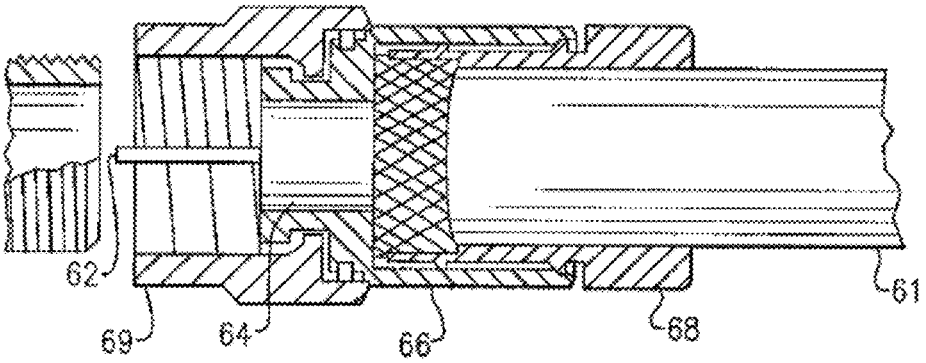

Specifically, FIGS. 1*a* and 1*b* illustrate an uncompressed and a compressed connector, respectively, for braided coaxial cables, including a cable connector 60 and a coaxial cable 61 having an end that has been prepared to accept the cable connector 60. A portion of the cable has been stripped at the end of the cable 61 to expose a length of the center conductor 62. In addition, a portion of the outer barrier, jacket or sheath of the cable has been removed to expose a length of the inner dielectric material 64 along with a woven wire mesh 65, interposed between the inner dielectric layer 64 and the outer barrier. The woven wire mesh 65, or the outer conductor of the coaxial cable 61, is rolled back over the barrier layer and, as such, is referred to as the "prepared end" of the coaxial cable 61. While, in the current embodiment, a "prepared end" of the coaxial cable includes stripping back material to expose a portion of both the inner and outer conductors 62 and 65, respectively, The connector 60 includes a non-deformable main body 66, a hollow post contained therein, and a threaded nut 69 rotatably secured to one end of the post. The connector 60 may or may not be fabricated from a conductive material. Commonly, the prepared end of the cable 61 is passed into the connector 60 through an annular compression ring 68 such that the hollow post 64 interposes the woven mesh 65 and the inner dielectric layer 64. The compression ring 68, which is initially coaxially aligned with, and partially inserted into, an end of the non-deformable connector body 66, is forcibly inserted into the end of the body 66. Furthermore, the compression ring 68 circumscribes an elongate axis 60A of the connector 60 and translates axially to effect a radial deformation of the compression ring 68 against the rolled or folded-back end of the outer conductor 65. This results in a positive physical and electrical connection between the coaxial cable 61 and the cable connector 60. Furthermore, as will be discussed in greater detail hereinafter, the annular compression ring 68 is aligned with the connector 60, i.e., the connector body, such that it imposes a strict or pure axial force along the elongate axis of the connector 60, That is, the axial force imposed on the annular compression ring 68 is strictly aligned with the elongate axis 60A of the connector body 60 such force couplings or bending moment loads are mitigated or entirely eliminated. In this way, strict radial loads are imposed to compress the annular ring 68 against the outer jacket, woven outer conductor, and cylindrical conductive post of the cable connector 60.

Figure 1C:
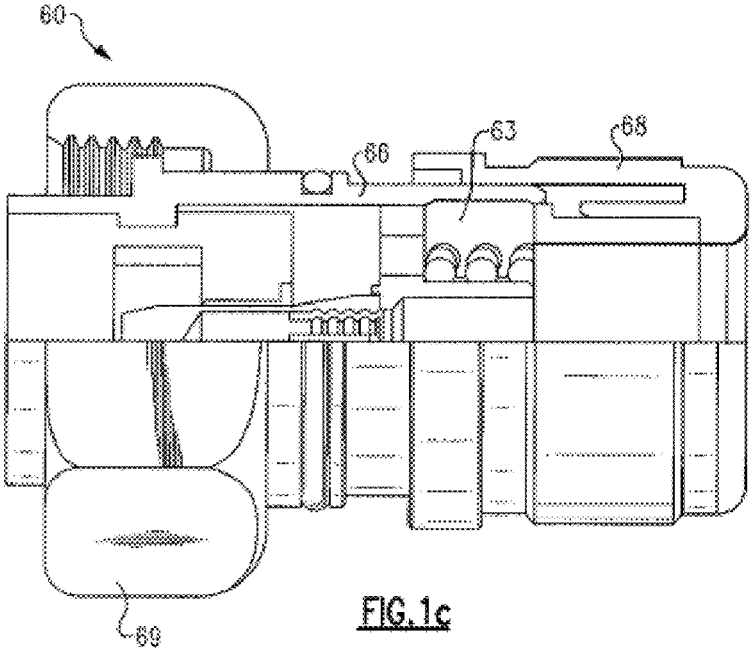
Figure 1D:
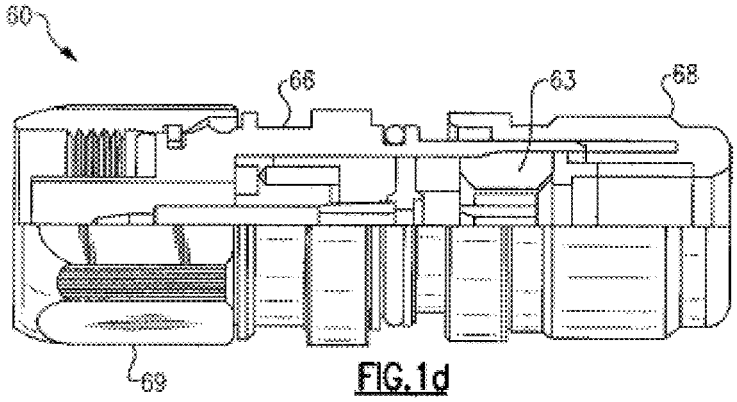

Whereas FIGS. 1*a* and 1*b* illustrate an outer conductor formed from a flexible wire braid, FIG. 1*c* illustrates a semi-rigid, thin-walled, outer conductor, and FIG. 1*d* illustrates a corrugated outer conductor. The connectors shown in FIGS. 1*c* and 1*d* are more thoroughly disclosed in Chawgo U.S. Pat. No. 7,993,159 entitled "Compression Connector for Coaxial Cable" filed May 2, 2007 and issued Aug. 9, 2011 and is hereby incorporated by reference in its entirety.

The connectors shown in FIGS. 1*c*-1*d* include a non-deformable main connector body 66 and a threaded nut 69 rotatably secured to one end of the connector body 66. The compression ring 68 is inserted into the back end of the connector body 66 while the prepared end of the cable 61 is passed into the connector 60 through the compression ring 68. The cable is secured by a clamp 63. As is well known in the art, an axially-directed force on the connector 60 produces radial deformation of the compression ring 68 within the connector body 66. This, in turn, results in a friction fit of the prepared end of the cable 61 as the compression ring 68 secures the prepared end within the connector body 66 by its radial compression within the connector body 66. Although specific conductor/connector types, i.e., braided, smooth, corrugated and superflex spiral conductor cables, are illustrated in FIGS. 1*a*-1*d*, a skilled artisan will appreciate that the compression tool of the present invention can be used with most any type of coaxial cable and connector in present day use.

Figure 2:
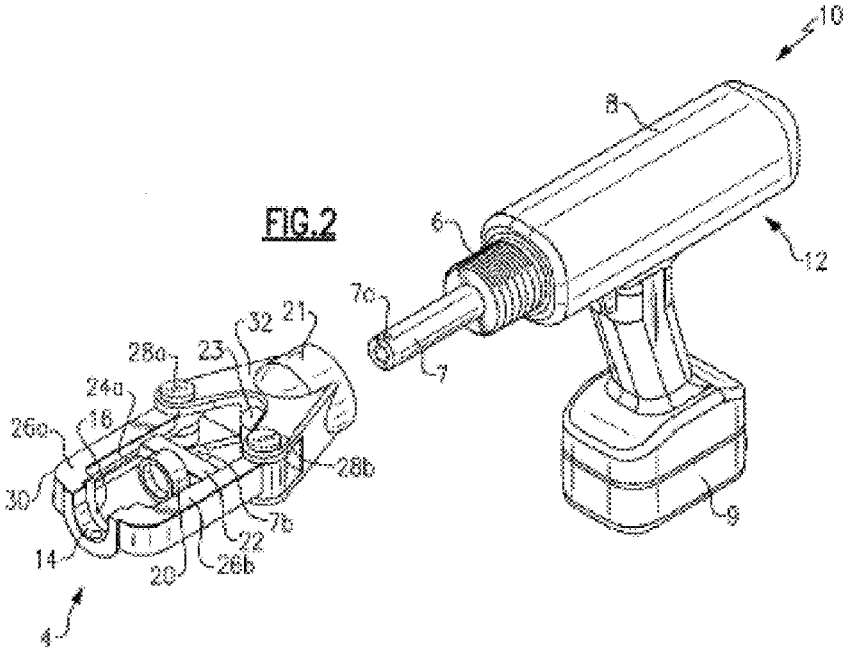
FIG. 2 illustrates one embodiment of the compression tool/frame assembly for installing a cable connector at a terminal end of a coaxial cable.

FIG. 2 illustrates an assembly for use in combination with a compression tool operative to connect a prepared end of a coaxial cable to a cable connector. The compression tool 10 is operative to produce an input force to an assembly 4 which captures, secures and imposes the requisite forces to drive the annular compression ring over the connector body, which as discussed above, secures the prepared end of the coaxial cable to the cable connector. The compression tool 10 of the type useful for practicing the invention may be hydraulically-, pneumatically-, or electrically-powered. Such compression tool is commercially available from Greenlee Textron Inc. located in Rockford, State of Illinois, under the model number ECCX or CCCX, The hydraulic version of the compression tool 10 includes a housing 8, a battery 9, an electric motor (not shown), a hydraulic fluid reservoir (not shown), a hydraulic pump (not shown), and an extendable plunger/ram 7. The plunger/ram 7 telescopes or is extendable along the longitudinal axis 8A of the housing 8 and may include an aperture 7*a* for connecting the plunger/ram 7 to other parts by a pin of a suitable size.

The compression tool 10 may also include a frame 4 including a cradle 14 bifurcating, and disposed at the base of, a y-shaped yoke configured to engage connectors 60 of various sizes. In the described embodiment, the cradle 14 receives the prepared end of the coaxial cable 61 to allow the connector body 66 to receive the cable at one end of the connector 60. In the described embodiment, the cable cradle 14 includes a shoulder 16 for engaging one end of the cable connector 60 while the other end of the frame 4 includes an end fitting 21 suitably configured to detachably connect to the compression tool 10. In this embodiment, the end fitting 21 includes a sleeve 20 which is also configured to accommodate connectors 60 of various sizes and types. In the illustrated embodiment, the sleeve 20 can be attached to a sliding bar or cross-member 22 which engages a pair of structural members 26*a*, 26*b* disposed on each side of the cross-member 22. In the described embodiment, the cross-member 22 is generally orthogonal to the arms of the y-shaped yoke and translates in the plane defined by the arms of the yoke. The ends of the cross-member 22 are disposed within, and guided by, a sliding guide 24*a* disposed in each of the structural members 26*a*, 26*b*. In the illustrated embodiment, the structural members 26*a*, 26*b* structurally interconnect or link the cradle 14 to the end fitting and, as such, the cross-member 22 and sleeve 20 are guided in a plane defined by and between the structural members 26*a*, 26*b*. As will be discussed in greater detail below, the frame, cross-member 22 and sliding guides 24*a*, 24*b* provide virtually pure axial translation of the compression member along the longitudinal axis of the connector.

In one embodiment, the cable cradle 14 and structural members 26*a*, 26*b* form a U-shaped frame or yoke 30. In another embodiment, the structural members of the U-shaped frame 30 can be attached by two fasteners 28*a* and 28*b* to the end fitting 32. While the described embodiment depicts a pair of structural members 26*a*, 26*b* disposed to each side of a cable connector 60, it will be appreciated that the structural members may take any form which structurally interconnects or links the cradle 14 to the end fitting of the frame assembly 4.

The end fitting 21 of the frame assembly 4 may include a threaded portion adapted to threadably engage a male fitting of the compression tool 10. The end fitting 21 may also include an aperture for receiving the plunger/ram 7 responsive to input from the compression tool 10. A skilled artisan will appreciate that the end fitting 21 may take a variety of forms, shapes or configurations to quickly connect/disconnect the frame assembly 4 from the compression tool 4.

Figure 3A:
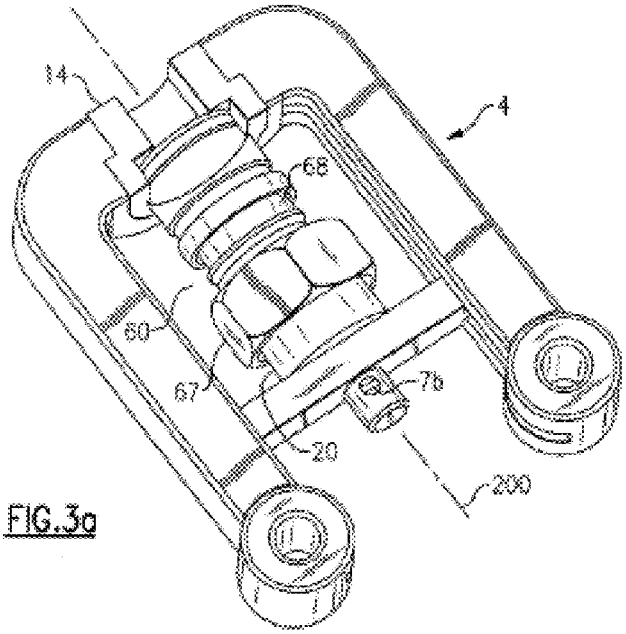
FIGS. 3*a* and 3*b* illustrate a cable connector compressed by the compression tool of the present invention.
Figure 3B:
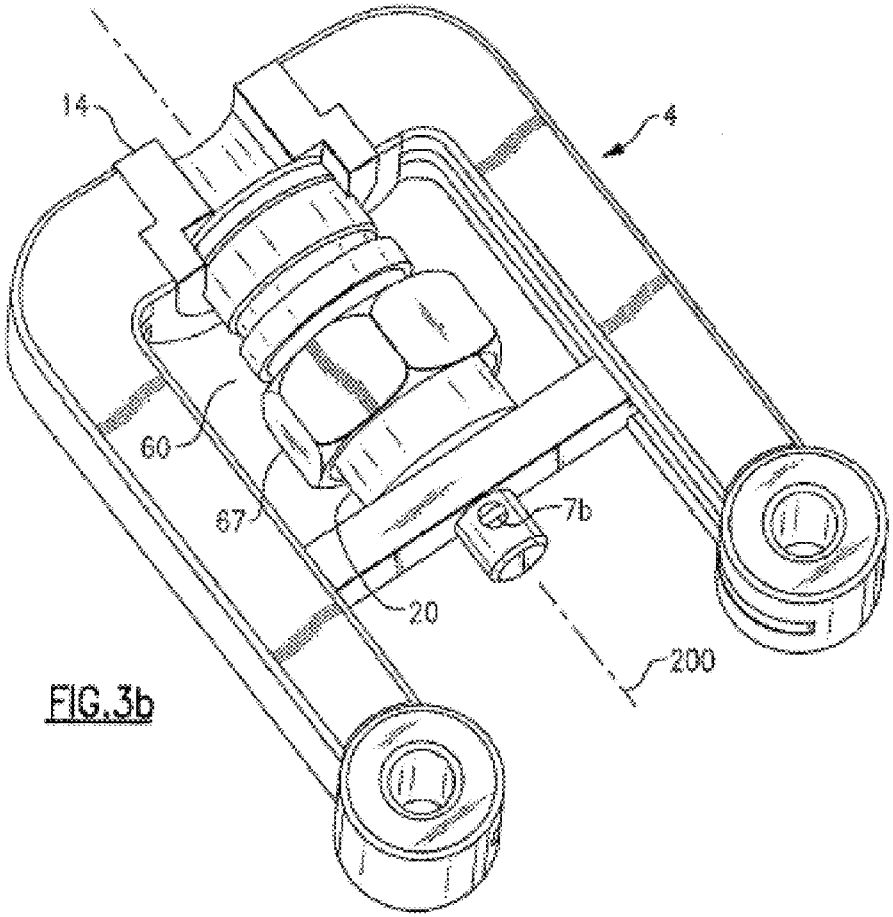

FIGS. 3*a* and 3*b* illustrate a connector 60 before and after having being compressed by the hydraulic compression tool 10 of the present invention. The cable connector 10 is placed into the frame assembly 4 so that the deformable portion of the cable connector, i.e., the portion including the compression ring, is received in the cable cradle 14, while the rotatable nut 67 of the connector 60 is received by the sleeve 20. A prepared end of coaxial cable (not shown) is inserted into the deformable portion of the connector 60. The operator activates the hydraulic assembly portion 12 of the compression tool 10, so that the extendable plunger/ram 7 of the hydraulic assembly portion 12 extends and moves the sliding bar of the plunger/ram along the longitudinal axis of the cable connector 60. Operationally, the axial motion of the plunger/ram 7 causes an annular compression ring 68 to move over the connector body 66 and radially compress the connector 60 along the longitudinal or elongate axis 200 thereof. Furthermore, radial compression by the compression ring 68 causes the coaxial cable 61 to be secured in combination with the cable connector 60.

Figure 4A:
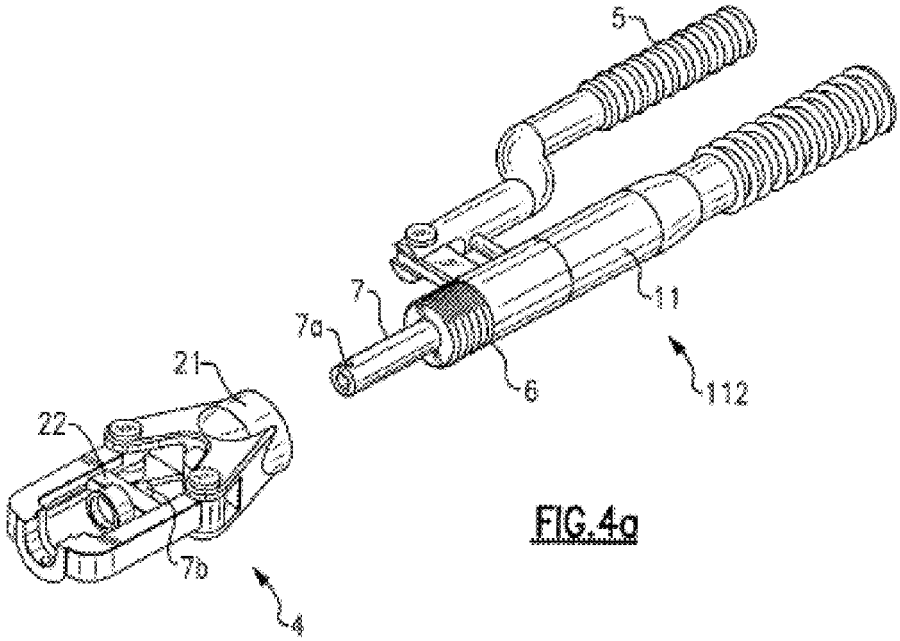
FIGS. 4*a* and 4*b* illustrate an embodiment of the present invention, where the assembly is activated by a manually powered compression tool.
Figure 4B:
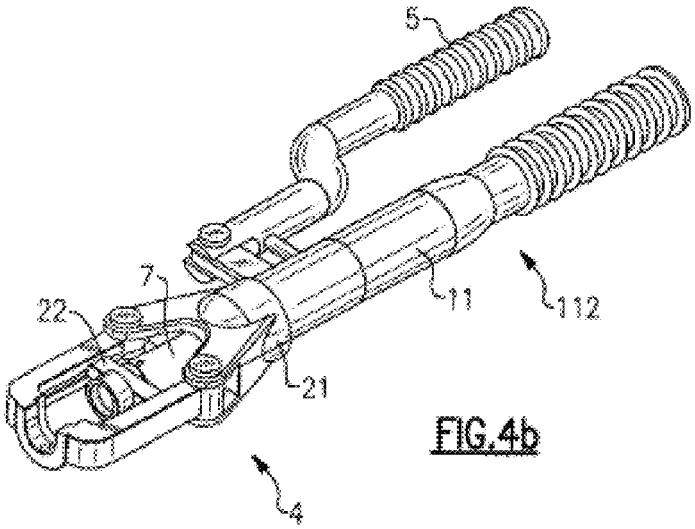

In another embodiment of the present invention, illustrated in FIGS. 4*a* and 4*b*, the hydraulic assembly can be manually operated, e.g., a model HCCX or HCCXC available from Greenlee Textron Inc. (Rockford, Ill/). The assembly 112 may include a housing 11, a handle 5, a hydraulic fluid reservoir (not shown), and a hydraulic pump (not shown). The assembly 112 can further include a plunger/ram 7 which may be connected to an extendable ram (not shown) for displacement/movement along the longitudinal axis of the housing 11 of the hydraulic assembly 12. The plunger/ram 7 may include an orifice 7*a* operative to connect the ram to other parts by a pin of suitable size.

The hydraulic assembly 112 may include an outer surface 6 having a plurality of external threads. The end fitting 21 of the frame assembly 4 may threadably engage the external threads such that the frame 4 detachably mounts to the hydraulic assembly portion 112 of the compression tool 10. The end fitting 21 can have an aperture/opening 23 to receive the plunger/ram 7 while apertures 7*a* and 7*b* may be provided to insert a pin (not shown) for connecting the plunger/ram 7 to the sliding bar 22 of the frame assembly 4. FIG. 4*b* illustrates the frame 4 attached to the hydraulic portion of the compression tool 10.

Figure 5A:
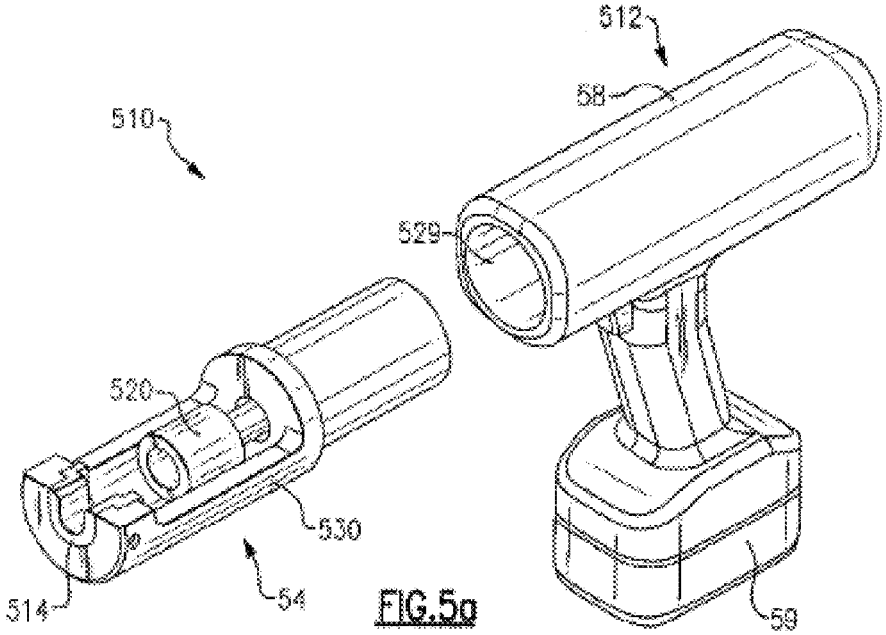
FIGS. 5*a*-5*c* illustrate another embodiment of a compression tool having a tubular frame assembly for installing a cable connector to a coaxial cable.
Figure 5B:
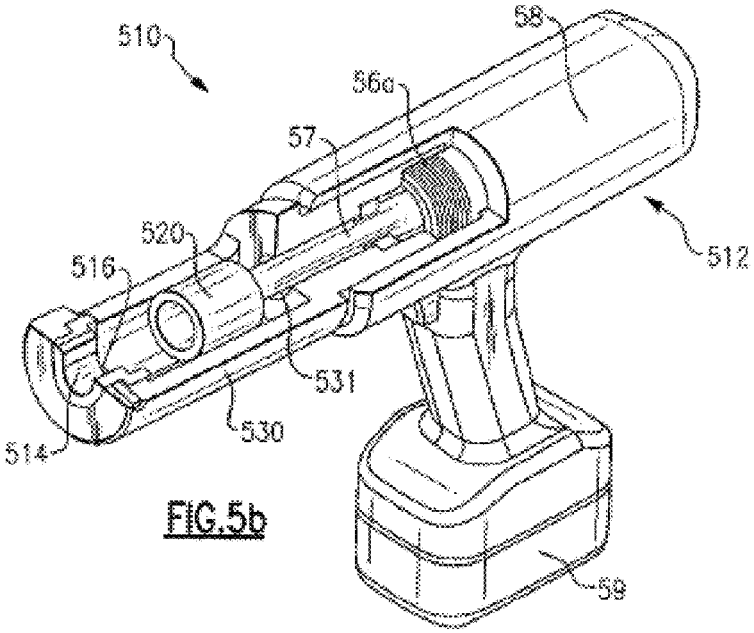
Figure 5C:
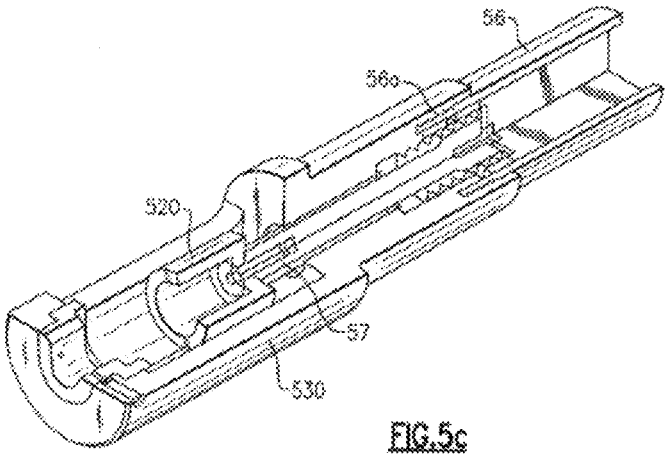

FIGS. 5*a*-5*c* depict yet another embodiment of the compression tool 10 for installing a cable connector 60 onto a coaxial cable 61, wherein the frame assembly 4 is suitable for mounting to a hybrid battery-operated compression tool 510. In this embodiment, the compression tool 510 may include a battery-operated hydraulic assembly 12, available for purchase under the model designation Compact 100-B from Ridge Tool Company, located in the City of Elyria, State of Oregon. The hydraulic assembly 512 may include a housing 58, a battery 59, an electric motor (not shown), a hydraulic fluid reservoir (not shown), and a hydraulic pump (not shown). As best seen in FIG. 5*c*, the hydraulic assembly 512 may further include a mounting cylinder 56, and a ram 57 which can be extendable along the longitudinal axis of the housing. The compression tool 510 may further include a frame assembly 54 forming a tubular structure 530. The tubular structure is open-faced, along one side, to receive a cable connector and includes an internal surface for guiding the sleeve 520 in response to axial displacement of the extensible plunger/ram 57. A skilled artisan would appreciate the fact that the open-faced tubular structure 530 can have form factors different from illustrated herein.

The frame assembly 54 may further include a cable cradle 514 attached to one end of the frame 530, best viewed in FIG. 5*b*. The cable cradle 514 may include a shoulder 516 for engaging one end of the cable connector while the other end of the connector may be received by a sleeve 520. The sleeve 520 can be configured to accommodate cable connectors of various sizes. The sleeve 520 may be attached to an extendable ram 57 by a pin or bolt 521 while the ram 57 is received through an opening 531 in the frame 530. In one embodiment, the frame 530 may include female threads at one end for threadably engaging male threads 56*a* at the other end. The male threads are disposed along the external surface of a mounting cylinder 56 of the compression tool 10.

Figure 6A:
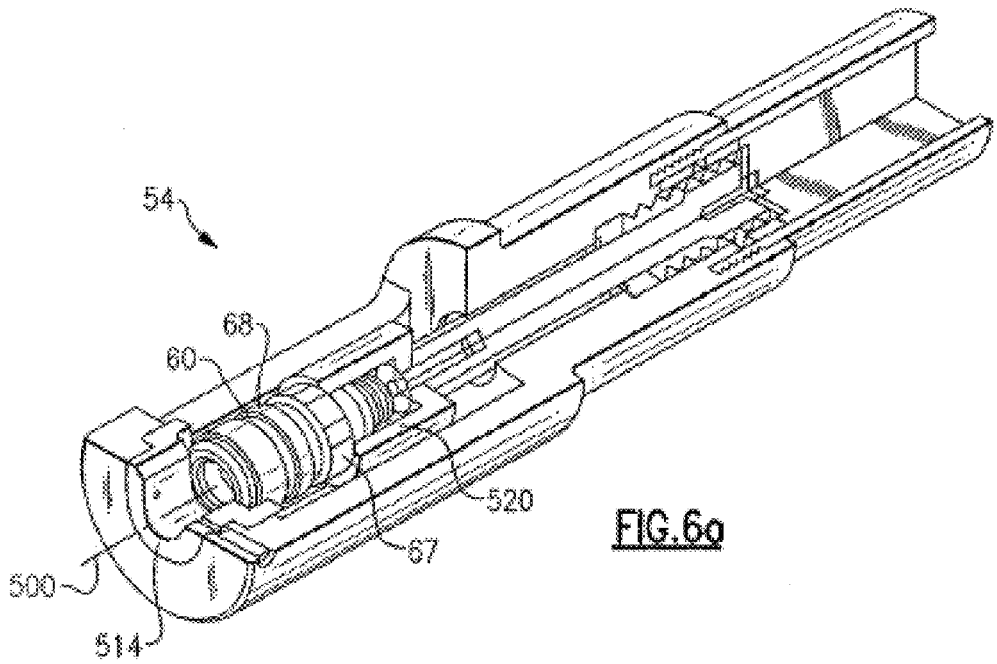
FIGS. 6*a* and 6*b* illustrate a cable connector being compressed by the compression tool shown in FIGS. 5*a*-5*c*.
Figure 6B:
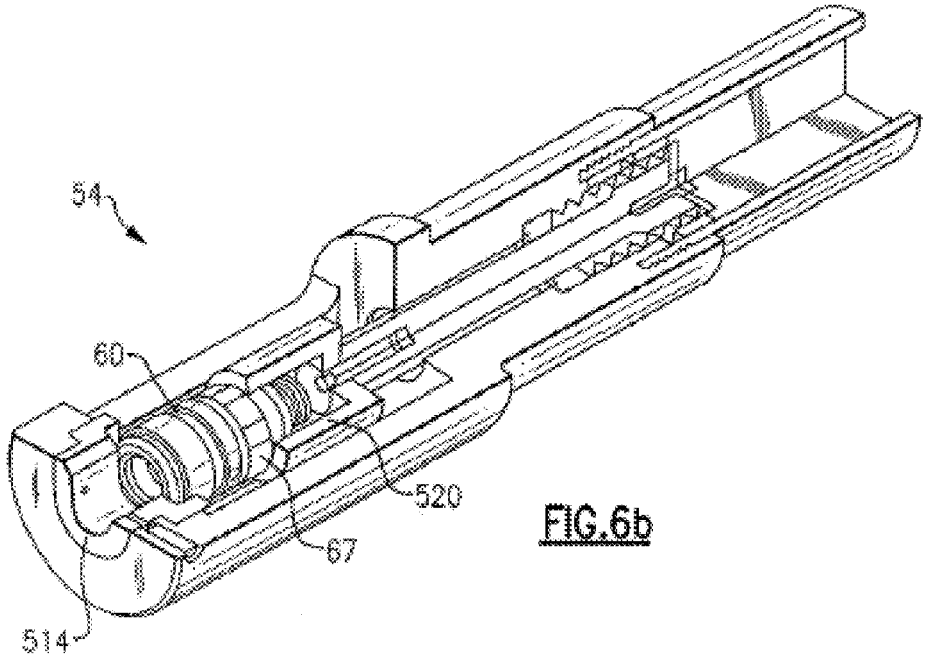

FIGS. 6*a* and 6*b* illustrate a cable connector before and after having being compressed by the hydraulic compression tool according to the embodiment of FIGS. 5*a*-5*c*. The cable connector 60 is placed into the frame assembly 54 so that the deformable end of the connector is received by the cradle 514, while the connector nut is received within the sleeve 520. Prior to placing the connector 60 into the cradle 514, a prepared end of coaxial cable (not shown) is inserted into the deformable end of the connector 60. Operationally, the operator activates the hydraulic assembly 512, so that the extendable ram 57 of the hydraulic assembly 512 is displaced along the longitudinal axis of the connector while the compression member is guided by the frame 4. Axial displacement of the compression member causes the annular compression ring 68 to engage and compress the connector body 66 along the longitudinal axis 500. The axial displacement of the compression ring 68 effects radial compression of the outer jacket and outer conductor against the conductive post of the connector 60 which, in turn, secures the coaxial cable to the cable connector 60.

Figure 7:
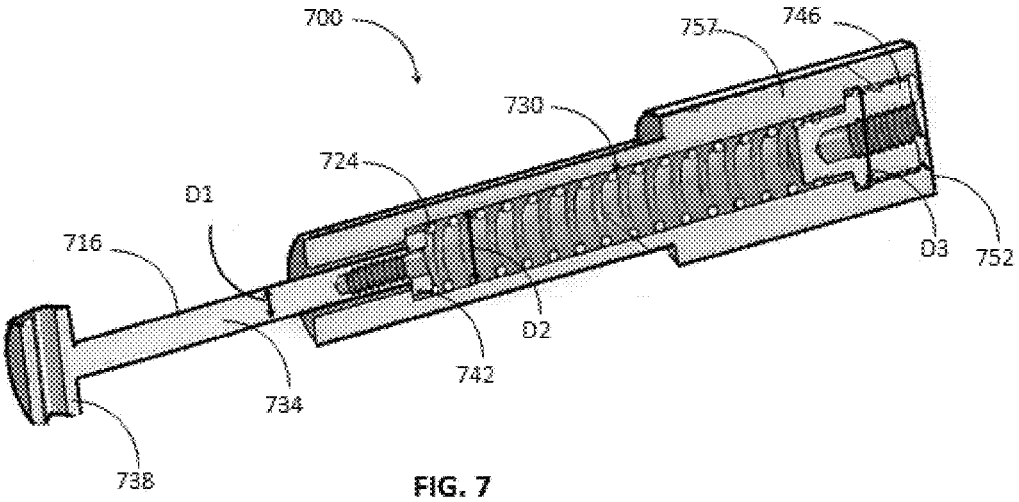
FIG. 7 illustrates another embodiment of the compression tool including an internally-biased extendible plunger/ram.

In another embodiment, shown in FIG. 7, a compression member 700 includes an ram 757 and a plunger 716 disposed internally of, and telescoping with respect to, the ram 757. In the described embodiment, the plunger 716 is biased outwardly by an internal coil spring 724 which is disposed within a bore 730 of the ram 757. The bore 730 varies in diameter and includes a first diameter D1 for slidably receiving a shaft 734 of the plunger 716 at a first end 738 of the ram 757, a second diameter D2 for slidably receiving a cylindrical end 742 of the plunger 716, and a third diameter D3 for receiving an end plug 746 which is press fit or threadably connected in a second end 752 of the ram 757.

The extensible ram 757 may be received within the aperture (not shown) of the end fitting 21 such that the frame 4 and the extensible ram 757 define an integrated unit or assembly which may be insert into the compression tool 700. As a consequence, one end of the connector 60 may be placed within the cradle 14, 514 while the other end may be received within a sleeve (not shown) which connects to the outboard end 760 of the plunger 716. Connectors of various size, therefore, may be placed within, and secured by, the spring-loaded plunger 716 during preparation and set-up of the frame, i.e., prior to insertion into the hydraulic/pneumatic/battery-operated portion of the compression tool 700. Upon insertion, the ram 757 may activate a switch which enables hydraulic fluid or air to power the extensible ram 757, i.e., provide the requisite input force to compress the annular compression ring over the connector body.

It will be appreciated that each frame assembly 4, 54 described supra employs a variety of means for guiding the compression member including a cross member 22 (FIG. 2) engaging a track, rail or slot 24*a*, 24*b* formed in the arms 26*a*, 26*b* of the y-shaped yoke 30. The means for guiding may also include an open-faced tubular structure 530 having an internal surface for guiding the sleeve 520. Additionally, or alternatively, the second end of the detachable frame 54 may include a cylindrical aperture for guiding the plunger/ram 57. It will be appreciated that a variety of means may function in the capacity of guiding the compression member along the longitudinal or elongate axis 200, 500 of the cable connector. For example, the first end or cradle may telescope inwardly along a guide surface formed between the first and second ends of the frame structure. In this embodiment, the compression member may or may not extend outwardly inasmuch as the first end moves inwardly while the compression member may remain stationary. Accordingly, relative motion may be employed to effect the requisite compressive displacement.

From the variety of embodiments described and depicted, it should be apparent that the present invention rapidly prepares the cable connector for being secured to the cable, vastly reduces the need for precision setup, provides significant time savings for the operator, offers significant fiscal advantages and greatly reduces the rejection and rework of coaxial cable connectors. In another embodiment of the invention, the means for aligning the cable connector employs a spring-biased plunger to accommodate connectors of various size. Accordingly, the plunger need only be retracted and released to hold the connector in place, while the operator readies the compression tool, i.e., inserts the frame and internally-biased plunger into the compression tool and threadably engages the frame with the compression tool, for connecting the compression ring to the connector body.

Hence, it will appreciated that the frame produces a plane and provide alignment along an axis (tubular or otherwise). Hence, the frame support may take the shape of a tube, elongate box, elongate frame, or elongate plane, provided that the forces are equal such that force couplings in pitch, roll, yaw, bending, or torsional are equaled or cancelled.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed:

1. A tool fixture for use in combination with a compression tool having a tool axis, comprising:

a compression member configured to receive a force input from the compression tool along a force input axis which is aligned, and co-incident with, the tool axis, the compression member comprising, a ram defining a bore, a plunger at least partially positioned within the bore of the ram, and a coil spring positioned within the bore of the ram and configured to engage the plunger and an end of the ram to biasingly engage an end of a cable connector; and a frame including a cradle at a first end, an end fitting at a second end, and at least one structural member linking the cradle to the end fitting, the at least one structural member defining a guide surface extending along the tool axis, wherein the cradle is configured to engage one end of a connector and receive an end of a coaxial cable, wherein the end fitting is configured to detachably connect the frame to the compression tool and having an aperture for receiving the force input from the compression tool through the compression member, and wherein the compression member is configured to contact the guide surface and be guided along the guide surface in response to;

an axial force imposed on an opposing end of the connector.

2. The tool fixture of claim 1 wherein the structural member reacts to the force input as an axial load in a plane defined by the frame.

3. The tool fixture of claim 1 wherein the frame reacts to the force input from the compression member along the axis.

4. The tool fixture of claim 1 wherein the plunger engages an end of the connector to accommodate connectors of varying length.

5. The tool fixture of claim 1 wherein the bore of the ram member varies in diameter and includes a first diameter for slidably receiving a shaft of the plunger, a second diameter for slidably receiving a cylindrical end of the plunger, and a third diameter for receiving an end plug to abut an end of the coil spring.

6. The tool fixture of claim 4 further comprising a sleeve connecting, and configured, to receive the opposite end of the connector, and wherein the sleeve is configured to accommodate connectors of various sizes.

* * * * *